United States Patent [19]

Mink

[11] Patent Number: 4,858,933

[45] Date of Patent: Aug. 22, 1989

[54] GAME ARTICLE SELECTION APPARATUS

[76] Inventor: George Mink, 38296 Horseshoe Dr., Mt. Clemens, Mich. 48043

[21] Appl. No.: 199,720

[22] Filed: May 27, 1988

[51] Int. Cl.[4] ..... A63F 9/00

[52] U.S. Cl. ..... 273/144 A; 221/203; 273/144 B

[58] Field of Search ..... 273/144 R, 144 A, 144 B; 221/192, 203, 204, 205

[56] References Cited

U.S. PATENT DOCUMENTS

| | | | |
|---|---|---|---|
| 1,377,936 | 5/1921 | Smith . | |
| 1,929,788 | 10/1933 | Myers et al. . | |
| 1,977,814 | 10/1934 | Warner . | |
| 2,203,886 | 6/1940 | Zamora | 273/144 A |
| 2,436,816 | 3/1948 | Meyer . | |
| 2,490,144 | 12/1949 | Masten | 273/144 A |
| 2,539,216 | 1/1951 | Weinschenk . | |
| 3,057,625 | 10/1962 | Livingston | 273/144 R X |
| 3,244,319 | 4/1966 | Fessman . | |
| 3,468,542 | 9/1969 | Ernst | 273/144 R |
| 4,616,831 | 10/1986 | Testerman | 273/144 B |

*Primary Examiner*—Anton O. Oechsle
*Attorney, Agent, or Firm*—Basile and Hanlon

[57] ABSTRACT

An article selection apparatus includes a housing with a hollow internal cavity in which is mounted a rotatable base. A peripheral, annular groove is formed in the base for aligning articles loosely disposed in the hollow cavity in the housing in single file. An inclined chute is mounted within the housing with a first end disposed in proximity with the groove in the base such that articles disposed in the groove are urged upward along the chute under centrifugal force imparted to the articles by rotation of the base and the momentum of succeeding, abutting articles in the groove. A discharge sleeve is mounted in the housing with one end disposed externally of the housing and another end located internally within cavity and spaced from the discharge end of the chute. Articles having a predetermined amount of momentum traverse the distance between the spaced ends of the chute and the sleeve for collection in the discharge sleeve.

12 Claims, 2 Drawing Sheets

GAME ARTICLE SELECTION APPARATUS

BACKGROUND OF THE INVENTION

1. Field of the Invention

The present invention relates, in general, to article dispensing apparatus and, specifically, to article dispensing apparatus which randomly select and dispense articles in a controlled manner and, more specifically, to game article dispensing apparatus for randomly selecting game articles one at a time.

2. Description of the Prior Art

Dispensing devices are widely employed to select and dispense articles from a bin or hopper containing a large number or bulk supply of articles in a controlled manner, such as successively, one at a time. Such devices are used in manufacturing operations to select and align small parts in a single line for loading or insertion into other parts.

Article dispensing apparatus of the type described above also are employed in games to randomly select one article from a large number of loosely arranged articles. Such articles, typically in the form of round balls, carry indicia, such as numbers or letters, for use in playing a game or to award prizes. Such devices typically incorporate a rotatable drum or pan containing a plurality of loosely arranged articles which are discharged from the pan one at a time when an outlet opening in the pan is aligned with a discharge chute. Most of the these devices utilize gravity to move the article from the spinning or rotating drum into the discharge chute with the result that the articles have little momentum when entering the discharge chute.

Despite the large number of dispensing apparatus which have been devised to randomly select and dispense articles from a bulk supply of articles, it would still be desirable to provide an article selection apparatus which increases the randomness of selection of single articles from a bulk supply of loosely arranged articles. It would also be desirable to provide an article selection apparatus which forcibly dispenses articles from a hopper with a high momentum or velocity. It would also be desirable to provide an article selection apparatus which has widespread application and can be used with different sized and shaped articles without significant modification.

SUMMARY OF THE INVENTION

The present invention is a game article selection apparatus which randomly selects articles one at a time from a bulk supply of loosely arranged articles. The apparatus includes a housing having a hollow cavity for containing a plurality of loosely arranged articles. A base is rotatably mounted in the housing and has an annular, peripheral groove formed therein for receiving articles in single file.

Means are provided for rotating the base to impart centrifugal motion to the articles disposed in the peripheral groove in the base. An inclined chute is mounted in the cavity in the housing and has a first end disposed in proximity with the groove in the base to receive articles therefrom. The chute inclines upwardly from the first end to a second discharge end. A discharge sleeve is mounted in the housing with a first end disposed interiorally within the cavity in the housing and spaced from the second discharge end of the inclined chute to receive articles from the chute which have a predetermined amount of momentum from being centrifugally spun by rotation of the base and the momentum of succeeding articles in the groove and chute to traverse the space between the discharge end of the chute and the first end of the discharge sleeve. The second end of the discharge sleeve is disposed exteriorly from the housing.

In a preferred embodiment, the base is horizontally positioned within the housing. The rotating means is in the form of a spindle affixed to the base with handles being attached to one end of the spindle for imparting rotation to the base.

The discharge sleeve, in a preferred embodiment, is pivotally mounted in the housing and the second end thereof is closed. This allows the articles discharged from the inclined chute to be collected in the discharge sleeve and returned to the interior cavity within the housing when a predetermined number of articles have been collected in the discharge sleeve. Alternately, the second end of the sleeve may be open to allow dispensing of the selected articles.

The present game article selection apparatus provides increased randomness in the selection of articles from a loose supply of articles since the articles are selected initially from the bulk mass of articles in the housing by being urged into the groove in the rotatable base and then only certain of these articles which have a predetermined amount of momentum imparted by a centrifugal rotation of the base and the momentum of succeeding, touching articles in the groove and chute to traverse the space between the end of the chute and the first end of the sleeve for collection in the discharge sleeve.

The game article selection apparatus of the present invention finds widespread use in many different applications, such as games or for article dispensing in manufacturing operations. The game article selection apparatus may also be employed with different shaped articles without significant modifications to the structure thereof.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
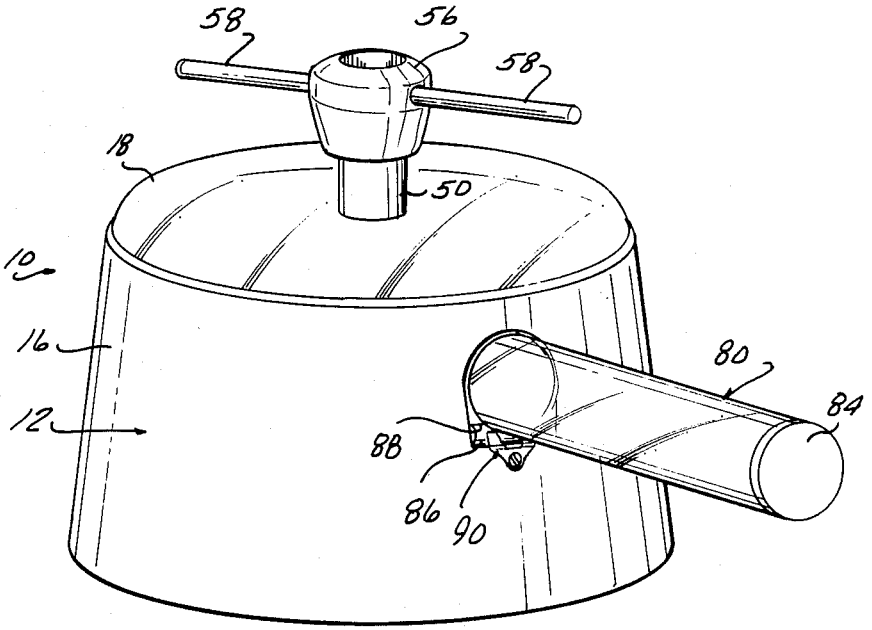
FIG. 1 is a perspective view of the game article selection apparatus of the present invention.

Throughout the following description and drawing, an identical reference number is used to refer to the same component shown in multiple figures of the drawing.

Figure 2:
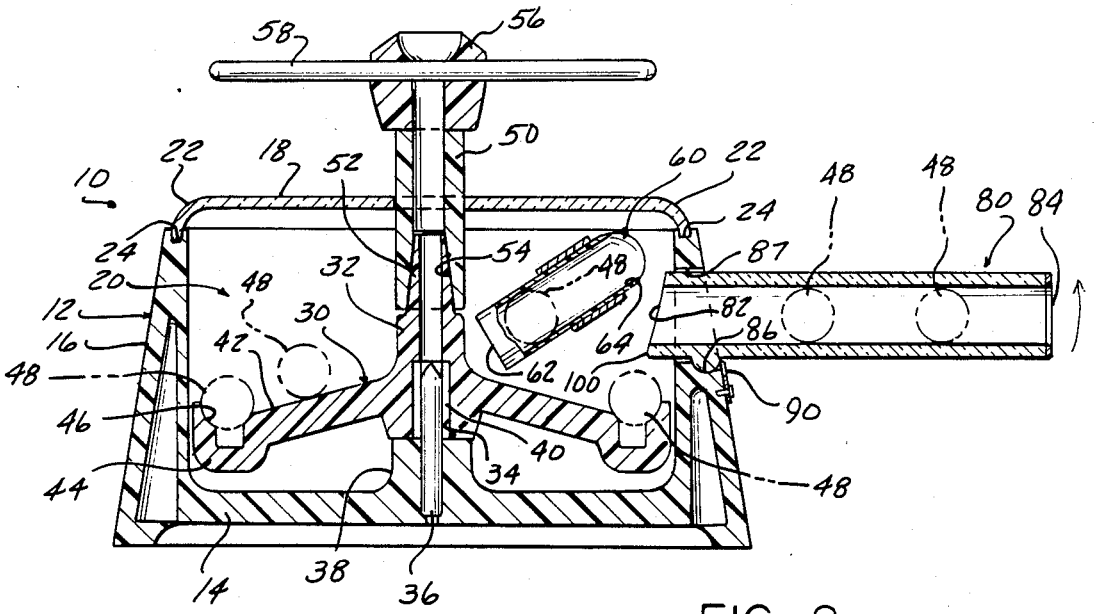
FIG. 2 is an elevational, cross sectional view of the game article selection apparatus shown in FIG. 1.

Referring now to the drawing, and to FIGS. 1 and 2 in particular, there is illustrated a game article selection apparatus 10 which selects articles at random one at a time from a loose bulk supply of articles. The game article selection apparatus 10 is ideally suited for selecting and collecting round balls one at a time for use in playing a game in which the balls carry indicia, such as letters, numbers or prize information. It will be understood that minor alterations to the shape and/or cross section of the article carrying portions of the apparatus 10 may be made to adapt the article selection apparatus 10 to different shaped articles, such as cylindrical, etc.

The game article selection apparatus 10 includes a housing 12 having a generally cylindrical form constructed of a planar bottom wall 14, an annular side wall 16 and a top 18. The bottom wall 14, side wall 16 and top 18 bound a hollow interior cavity 20 within the housing 12.

The housing 12 may be formed of any suitable material. In a preferred embodiment, the housing 12 is constructed of a moldable plastic in which the bottom wall 14 and side wall 16 are integrally formed as a single unit. The top 18 is removably mountable on the side wall 16 by implacing a downwardly extending annular rim 22 of the top 18 in an annular groove 24 formed on the upper edge of the side wall 16. The top 18 is preferably constructed of a transparent material, such as glass or plastic, to allow viewing of the interior cavity 20 of the housing 12.

As shown in FIG. 2, a base denoted in general by reference number 30 is rotatably mounted within the hollow cavity 20 in the housing 12. The base 30 has an integral one piece construction and is preferably formed of a moldable plastic material. The base 30 has a central enlarged hub portion 32 which includes a centrally located bore 34.

An elongated metallic pin 36 is affixed to a raised central portion 38 of the bottom wall 14 of the housing 12 and forms a pivot point for the base 30. A bronze bushing 40 is disposed within the bore 34 in the base 30 about the upper end of the pin 36 to provide a rotating surface for the base 30.

The base 30 also includes a planar pan portion 42 which inclines downward from the central hub portion 32 to an outer edge 44. A peripheral, annular groove 46 is formed in the outer edge 44 of the base 30 and has a cross section shaped to receive articles 48 therein in a single file. In the case of round articles 48, such as balls, the groove 46 is formed with a cross section adapted to loosely receive a round article 48 as shown in FIGS. 2 and 3.

Means are provided for rotating the base 30. While the rotating means may embody any suitable means, such as an electric motor to automatically rotate the base 30, in the illustrated embodiment, the rotating means is manually operated and comprises an elongated, cylindrical spindle 50 which is press fit over a tapered end portion 52 extending from the central hub portion 32 of the base 30. The spindle 50 is preferably formed of a lightweight plastic material and is provided with a tapered bore 54 insertable over the exterior surface of a tapered end portion 52 of the base 30. An enlarged head portion 56 is integrally formed with or affixed to the opposite end of the spindle 50 from the bore 54 and rod-like handles 58 extend outward therefrom to provide a grasping surface for manual rotation of the spindle 50 and the base 30.

Figure 3:
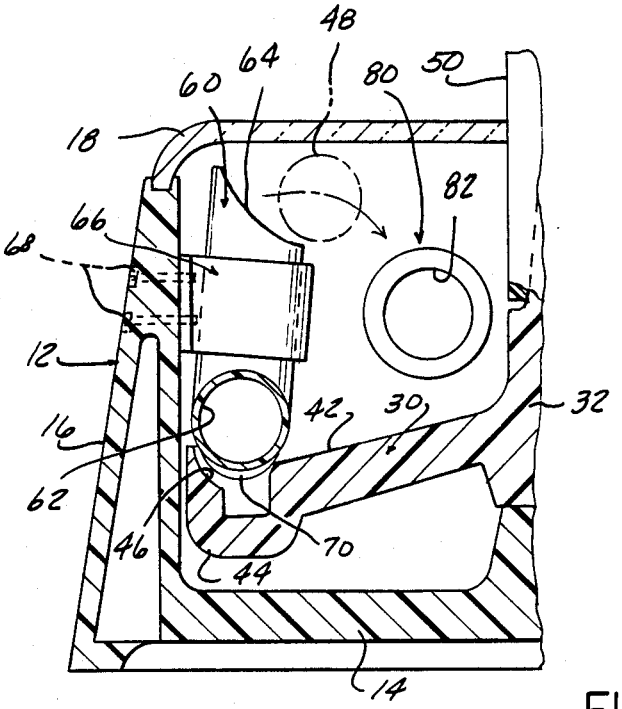
FIG. 3 is a partial, cross sectional view of the interior of the game article selection apparatus in FIG. 1 showing the arrangement of the inclined chute and discharge sleeve.

As shown in FIGS. 2 and 3, the game article selection apparatus 10 also includes an inclined chute 60. The chute 60, which is preferably formed of a plastic material, has a hollow, tubular form with a cross section configured to slidably receive an article 48, such as a round ball, therethrough.

The chute 60 includes first and second open ends 62 and 64, respectively. The first end 62 of the chute 60 is disposed in proximity with the groove 46 in the base 30 to receive articles 48 therefrom, with the articles 48 being urged upwards along the length of the chute 60 by centrifugal force imparted thereto from rotation of the base 30 and the momentum of succeeding, touching articles 48 in the groove 46 and chute 60. The second end 64 of the chute 60 is cut at a radius as shown in FIG. 3 to allow sideways ejection of the articles 48 therefrom. Mounting means 66 is provided for mounting the chute 60 to the sidewall 16 of the housing 12. The mounting means 68 is generally in the form of an annular clamp which surrounds a portion of the chute 60. Fastening means 68 in the form of screws extend through the sidewall 16 to securely attach the mounting means 68 and the chute 60 to the sidewall 16 of the housing 12.

As shown in FIG. 3, a depending finger or flange 70 may be provided on the first end 62 of the chute 60. The flange 70 is configured to extend downward into the groove 46 in the base 30 to provide a support surface or ramp to aid in moving articles 48 in the groove 48 upward into the chute 60.

As shown in FIGS. 1–4, a discharge sleeve 80 is mounted to the housing 12. The discharge sleeve 80 is preferably formed of a lightweight plastic material and has a hollow, tubular construction. The sleeve 80 is provided with first and second ends 82 and 84, respectively, with the first end 82 positioned interiorally of the housing 12 within the hollow cavity 20 and the second end 84 positioned exteriorly from the housing 12. The sleeve 80 extends through an aperture 87 in the sidewall 16. Preferably, the second end 84 is closed by means of a cap to allow collection of articles 48 in the discharge sleeve 80 as shown in FIG. 2 and their return to the cavity 20 in the housing 12. Alternately, the second end 84 may be open to allow dispensing of the collected articles 48 from the discharge sleeve 80.

As shown in FIG. 3, the first end 82 of the discharge sleeve 80 is positioned below and to the side of the second discharge end 64 of the chute 60 to create a space or distance between the two ends. Further, the first end 82 of the sleeve 80 is cut at a radius, as shown in FIG. 2, to serve as a collection lip for the articles 48 into the sleeve 80.

In a preferred embodiment, the discharge sleeve 80 is pivotally mounted on the housing 12 by means of a pivot pin 86 which is attached to or integrally formed with the sleeve 80. The cylindrical shaped pin 86 is located adjacent to the first end 82 of the sleeve 80 on a bottom side of the sleeve 80. The cylindrical pin 86 is configured to fit within a correspondingly shaped recess 88 formed in the sidewall 16 of the housing 12 below the aperture 87 in the sidewall 16.

Figure 4:
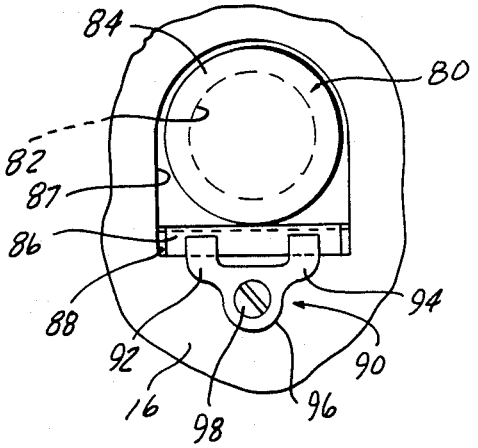
FIG. 4 is a partial, elevational view showing the mounting of the pivotal discharge sleeve on the housing of the game article selection apparatus shown in FIG. 1.

Biasing means 90 in the form of a spring is provided to bias and hold the pin 86 and the discharge sleeve 80 is position on the housing 12. As shown in FIG. 4, the spring 90 includes a planar body formed of a spring or resilient material which includes a pair of legs 92 and 94 which engage the cylindrical pin 86 on the sleeve 80. A central body integrally formed between the legs 92 and 94 receives a fastener 98 which extends therethrough into the sidewall 16 of the housing 12 to mount the biasing means 90 on the housing 12.

As shown in FIG. 2, a cam surface 100 is formed at the bottom edge of the first end 82 of the sleeve 80. The cam surface 100 is acted upon by articles 48 retained in the groove 46 in the base 30 as the base 30 rotates to urge the first end 82 of the sleeve 80 upward to the substantially horizontal position shown in FIG. 2 to position the discharge sleeve 80 to receive articles 48 ejected with sufficient momentum from the second end 64 of the inclined chute 60.

In operation, the discharge sleeve 80 is initially emptied of articles 48. A plurality of articles 48 are loosely disposed within the interior cavity 20 of the housing 12. A number of such articles 48 will fall into the peripheral, annular groove 46 in the base 30. Rotating the handle 58 causes rotation of the base 30 and imparts a centrifugal force on the articles 48 in the groove 46 applying momentum to the articles 48 and causing the articles 48 to assume an abutting, single file arrangement in the groove 46.

As the articles 48 reach the first end 62 of the inclined chute 60, they are urged upwards through the inclined chute 60 by the centrifugal force and momentum applied thereto by rotation of the base 30 and the momentum of succeeding, abutting articles 48 in the groove 46 and the chute 60. This momentum causes the articles 48 to be ejected from the second end 64 of the chute 60 under force. When such force or momentum is sufficient, the articles 46 traverse the space or distance between the second end 64 of the chute 60 and the first end 82 of the sleeve 80 and are caught in the radially cut first end 82 of the sleeve 80 and roll down the sleeve 80 toward the second end 84 as shown in FIG. 2.

Rotation of the base 30 is continued until a predetermined number of articles 48 are collected in the sleeve 80 as determined by the length of the sleeve 80. Randomness in the selection of the articles 48 which are collected in the sleeve 80 is assured due to the random arrangement of the articles 48 in the groove 46 in the base 30 and since only those articles 48 having a predetermined amount of momentum sufficient to traverse the distance between the spaced ends of the chute 60 and the sleeve 80 will be collected in the sleeve 80. Articles 48 not having sufficient momentum to traverse this distance will fall back into the interior cavity 20 in the housing 12 onto the base 30.

When the predetermined number of articles 48 have been collected in the sleeve 80, the sleeve 80 may be pivoted about the pin 86 by manually raising the second end 84 of the sleeve 80 in the direction of the arrow in FIG. 2 to cause the articles 48 contained within the sleeve 80 to fall back into the interior cavity 20 in the housing 12.

In summary, there has been disclosed a unique game article selection apparatus which provide a high degree of randomness in the selection of single articles from a bulk supply of articles. The game article selection apparatus finds widespread application and may be used with different size and shaped articles without significant modification to the structure thereof.

What is claimed is:

1. An article selection apparatus comprising:

a housing having a hollow cavity for receiving a plurality of loose articles;

a base rotatably mounted in the cavity in the housing, the base having an annular, peripheral groove formed therein for receiving articles in single file;

means for rotating the base;

an inclined chute mounted in the cavity in the housing and having first and second open ends, the first end being positioned proximate the groove in the base to receive articles therefrom, the chute inclining upward from the first end to the second end; and a discharge sleeve mounted in the housing and having first and second ends, the first end being open and disposed within the cavity in the housing and spaced from the second end of the chute to only receive articles discharged from the chute having a predetermined amount of momentum imparted thereto by being centrifugally spun by rotation of the base and the momentum of succeeding articles in the groove and chute sufficient to traverse the space between the second end of the chute and the first end of the sleeve, the second end of the sleeve being disposed exteriorly of the housing.

2. The article selection apparatus of claim 1 wherein the means for rotating the base comprises:

a spindle affixed to the base and extending outward from the housing; and a handle mounted on the spindle for rotating the spindle.

3. The article selection apparatus of claim 1 further including means for pivotally mounting the discharge sleeve on the housing.

4. The article selection apparatus of claim 3 wherein the means for pivotally mounting the discharge sleeve on the housing comprises:

a pin attached to the discharge sleeve;

a recess formed in the housing to rotatably receive the pin; and biasing means for biasing the pin into the recess in the housing.

5. The article selection apparatus of claim 1 wherein the second end of the discharge sleeve is closed.

6. The article selection apparatus of claim 1 wherein the first end of the discharge sleeve is spaced below and to the side of the second end of the chute.

7. The article selection apparatus of claim 1 wherein the housing includes:

a bottom wall, the base being rotatably mounted on the bottom wall;

a side wall; and a top mounted on the side wall.

8. The article selection apparatus of claim 7 wherein the top is removably mounted on the side wall of the housing.

9. The article selection apparatus of claim 7 further including:

a pin mounted on the bottom wall of the housing;

a bushing mounted about the pin and providing a rotating support surface of the base mounted thereover.

10. The article selection apparatus of claim 1 wherein the chute includes:

a depending flange extending downward from the first end of the chute into the area bounded by the groove in the rotatable base.

11. The article selection apparatus of claim 1 wherein the chute and discharge sleeve have a circular cross section.

12. An article selection apparatus comprising:

a housing having a bottom wall, a side wall and a top defining a hollow interior cavity for receiving a plurality of loose articles;

a base rotatably mounted on the bottom wall in the cavity in the housing, the base having an annular, peripheral groove formed therein for receiving articles in single file;

means for rotating the base to impart centrifugal motion to the articles in the groove;

an inclined chute mounted in the cavity in the housing and having first and second open ends, the first end being positioned proximate the groove in the base to receive articles therefrom, the chute inclining upward from the first end to the second end; and a discharge sleeve pivotally mounted in the housing and having first and second ends, the first end being open and disposed within the cavity in the housing and spaced below and to the side of the second end of the chute to only receive articles discharged from the chute having a predetermined amount of momentum imparted thereto by being centrifugally spun by rotation of the base and the momentum of succeeding articles in the groove and chute sufficient to traverse the space between the second end of the chute and the first end of the sleeve, the second end of the sleeve being disposed exteriorly of the housing.

* * * * *